US005165737A

United States Patent [19]

Riegelman

[11] Patent Number: 5,165,737

[45] Date of Patent: Nov. 24, 1992

[54] LATCH FOR TILT WINDOW

[75] Inventor: Harry M. Riegelman, Arlington, Tex.

[73] Assignee: Pomeroy, Inc., Stamford, Conn.

[21] Appl. No.: 865,569

[22] Filed: Apr. 9, 1992

[51] Int. Cl.[5] ..... E05C 1/10

[52] U.S. Cl. ..... 292/42; 49/176; 292/175; 292/DIG. 47

[58] Field of Search ..... 292/33, 42, 163, 175, 292/DIG. 47, 39, 40; 49/176

[56] References Cited

U.S. PATENT DOCUMENTS

| | | | |
|---|---|---|---|
| 3,668,906 | 6/1972 | Josephart | 292/42 X |
| 4,204,724 | 5/1980 | Bauer et al. | 292/42 X |
| 4,226,452 | 10/1980 | Hoffman et al. | 292/175 |
| 4,400,026 | 8/1983 | Brown, Jr. | 292/175 |
| 4,553,353 | 11/1985 | Simpson | 49/161 |
| 4,837,975 | 6/1989 | Simpson | 49/175 |

*Primary Examiner*—Richard E. Moore

*Attorney, Agent, or Firm*—Robert A. Seemann

[57] ABSTRACT

A housing with a top wall, upstanding parallel walls and two upstanding posts between the upstanding walls on a line parallel with the walls. Each post extends through an elongated opening in a first bolt which is mounted slidingly in the housing for reciprocation toward first and second ends of the housing. The bolt is extendible beyond the second end of the housing for engaging a window jamb when the housing is mounted on a sash of a tilt window that is fully seated in the jamb. The bolt is urged toward the second end by a spring in one of the elongated openings, bearing on the bolt and the post in the opening. A second bolt is supported slidingly between the first bolt and one of the walls, and is extendible beyond the second end for engaging the jamb. A portion of the first bolt extends through an upstanding wall, and a portion of the second bolt extends through the top wall.

9 Claims, 3 Drawing Sheets

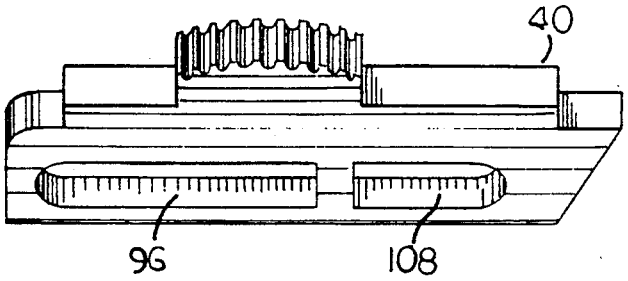
FIG. 5
FIG. 6
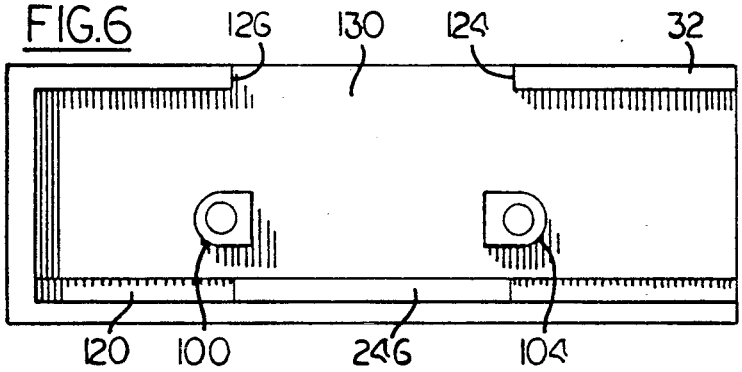
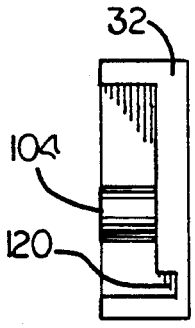
FIG. 7
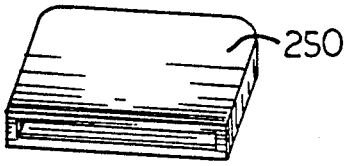
FIG. 9
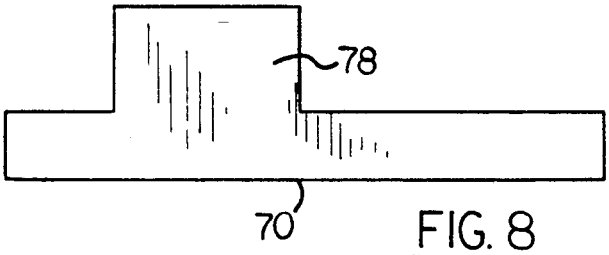
FIG. 8
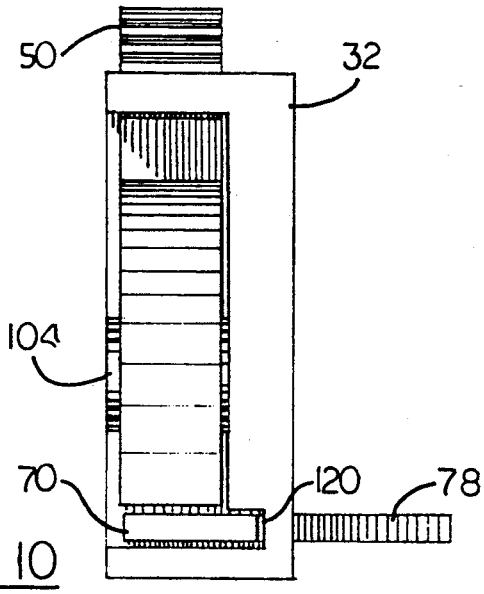
FIG. 10

LATCH FOR TILT WINDOW

BACKGROUND OF THE INVENTION

1. Field of the Invention

This invention relates to closure fasteners, more particularly to a manually operated latch for a single or double hung tilt window, which provides a snap tilt lock, sash lock, and vent lock for the window.

2. Description of the Prior Art

Latches for tilt windows generally include a spring biased bolt for engaging the jamb. Often the bolt head is beveled to force the bolt back when the window is rotated into the jamb whereupon the bolt snaps back into locking engagement with the jamb when the sash is rotated fully back into the jamb. Either a protruding or a recessed finger grip is provided for drawing the bolt back to release the bolt from locking engagement with the jamb so that the sash may be rotated out from the jamb.

U.S.P.N. 4,400,026 patented by J. M. Brown, Jr., Aug. 23, 1983 describes a tilt latch which includes a base for mounting on a sash by means of a screw through a screw hole that is located in the base, near the rear end of the base.

The base includes parallel side walls. A generally flat slide member is received in grooves in the side walls, for sliding to an extended locking position wherein a nose portion of the slide member extending over the front end of the base engages the jamb.

A spring is disposed between the base member and the slide member in a recess cooperatively defined by portions of the underside of the slide member and the upwardly facing surface of the base member. The spring is compressed between one end of the recess in the slide member and the head of the screw which holds the base on the sash, and biases the slide member toward the extended position.

Travel of the slide member to the extended locking position is limited by a downward directed ledge at the rear of the slide member, which engages the rear end of the base member.

A rearward portion of the slide member is resiliently deformable so that the rear end of the slide member can be pulled up, clearing the ledge from interference with the rear end of the base member. This permits moving the slide member in a direction of further extension in order to reveal the mounting screw in the base for mounting the tilt latch assembly on the frame.

U.S.P.N. 4,553,353, patented Nov. 19, 1985 by H. Simpson describes a pivotal window sash latch assembly which is mounted internally of the sash frame top. The latch includes a bolt for locking against window rotation by engaging the jamb. The bolt is slidingly clipped to the underside of a housing by flanges that extend below the housing.

An opening in the housing clears the way for fingers of a top mounted slider button which extend down through the opening to engage an opening in the slider for moving the bolt between extended and retracted positions. When the latch is installed in a sash, the housing is recessed into the sash with only the button extending above the top surface of the sash.

A spring for biasing the bolt in the direction of extension is located in a compartment in the bolt and bears at one end upon an abutting post which extends down from the housing, and at the other end in the direction of extension upon a wall of the compartment.

An elongated hole is provided in the slider to provide clearance for a mounting screw which passes down from the housing into the sash.

In U.S.P.N. 4,837,975, patented Jun. 13, 1989, H. Simpson describes an externally mounted latch for a pivotable sash window of a double-hung sash window assembly. The latch includes a housing including a rear and two downward depending side walls. A first downward extending post attached to the rear end side wall of the housing, has a through hole for attaching the housing to a sash. A second downward extending post located on the midline of the housing and spaced from an open front end of the housing also includes a through hole for attaching the housing to the sash.

Each side wall includes a short inwardly directed slider bearing segment for guiding the rear portion of a slider bolt which is retained under the housing by a retainer bar integral with the lower end of the second post. The second post passes through an elongated opening in the bolt, and the retainer bar traverses under the slider bolt, extending in the direction of the rear wall.

A spring for biasing the bolt toward the open end of the housing for locking engagement with a window jamb, is contained at one end by a wing portion of the bolt which extends from one side of the bolt near the front of the bolt, to a side wall. Another wing portion extends from the other side of the bolt, near the front of the bolt, to the other side wall.

The other end of the spring engages a spring stop pin which extends from one of the side wall slider bearing segments, in the direction of the open front end of the housing.

SUMMARY OF THE INVENTION

It is one object of the invention to provide a tilt lock for a single or double hung tilt window.

It is another object to provide a tilt lock that snap locks when the sash is rotated into the track.

Another object is to provide a tilt lock assembly which optionally locks the sash at any one of a plurality of locations along the track.

It is another object to provide a snap tilt lock, sash and vent lock, that is inexpensive to manufacture and simple to install and operate.

Additional objects and advantages of the present invention will be apparent to one skilled in the art, from reading the ensuing description of the invention.

A tilt sash according to the present invention includes a housing with a first wall, a second wall upstanding from the first wall, and a third wall upstanding from the first wall and generally parallel to the second wall.

First and second posts which are upstanding from the first wall, are spaced from each other toward first and second ends of the housing in a line that is generally parallel to the second wall.

A first bolt having first and second elongated openings is mounted slidingly in the housing with the first post in the first opening and the second post in the second opening, so that the bolt may sliding reciprocate toward the first and second ends of the housing. The bolt is extendible beyond the second end of the housing for engaging a window jamb when the housing is mounted on a sash of a tilt window that is fully seated in the jamb.

Spring means is mounted in one of the openings in the bolt, enclosed on three sides by the bolt, on a fourth side by the post in the opening, and bears upon the post and the bolt for urging the bolt towards the second end of the housing.

The first wall comprises holding means for receiving a second bolt slidingly for reciprocation toward the first and second ends of the housing, the second bolt being extendible beyond the second end of the housing for engaging the window jamb when the housing is mounted on the sash.

The holding means includes the third wall and a groove in the first wall.

A portion of the first bolt extends through an elongated opening in the second wall, and a portion of the second bolt extends through a slot which is included in the groove in the first wall.

BRIEF DESCRIPTION OF THE DRAWINGS

In order that the invention be more fully comprehended, it will now be described, by way of example, with reference to the accompanying drawings, in which:

FIG. 5 is a perspective view of a bolt of the invention.

FIG. 6 is a bottom view of a housing of the invention.

FIG. 7 is an end view of the housing of FIG. 6.

FIG. 8 is a side view of another bolt of the invention.

FIG. 9 is a perspective view of a finger cap of the invention.

FIG. 10 is an end view of an assembly of the invention.

DESCRIPTION OF THE PREFERRED EMBODIMENTS

Before explaining the invention in detail it is to be understood that the phraseology or terminology used herein is for the purpose of description and not of limitation, and that the invention is not limited in its application to only the detail of construction and arrangement of parts illustrated, since the invention is capable of other embodiments and of being practiced or carried out in various ways.

Figure 1:
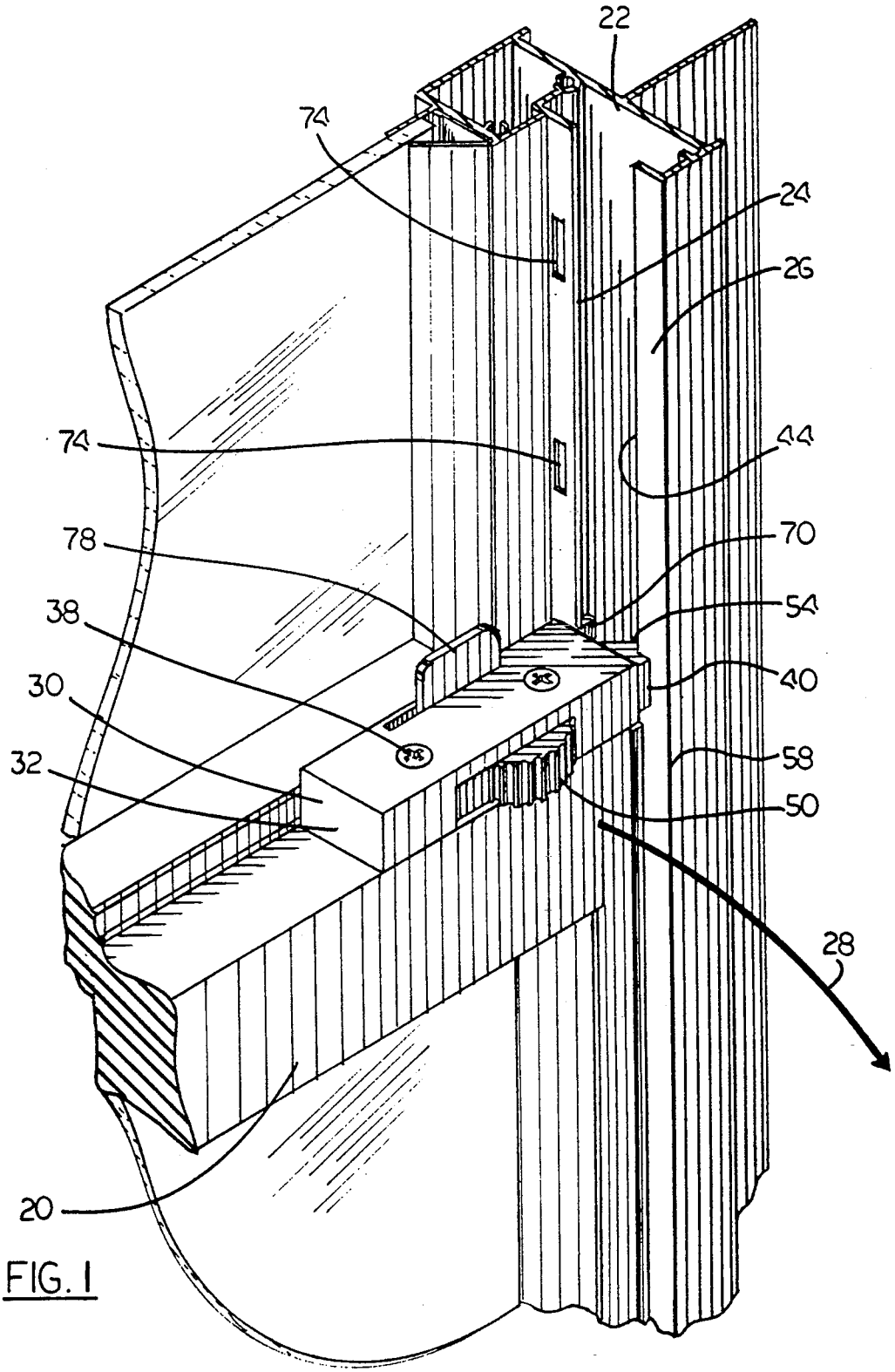
FIG. 1 is a perspective view of a latch of the present invention mounted on a sash that is in a window jamb.

Referring to FIG. 1 of the drawings, window sash 20 reciprocates slidingly along window jamb track 22 guides 24 and 26, and rotates as designated by arrow 28, in the manner of a conventional tilt window, laterally out of parallel alignment with track 22 upon pivot means located at the lower end of the sash (not shown).

Housing 32 of window latch 30 includes screws 38 for attaching the housing to the top end of the sash, adjacent to the track.

Bolt 40 of window latch 30 is spring-loaded for extending behind the rearward facing surface of a track guide as it is shown extending behind rearward facing surface 44 of guide 26, to resist by locking engagement with surface 44, rotation of the sash in the direction of arrow 28.

To release the sash for rotation, bolt 40 is momentarily drawn back by finger grip button 50 from engagement with surface 44.

During rotation of the sash back into the jamb, beveled face 54 of bolt 40 forces the bolt back from the guide as it engages the forward edge 58 of guide 26, so that the bolt can clear the guide, whereupon bolt 40 springs back to lock behind the guide once the sash is rotated fully back into the jamb.

Bolt 40 resists rotation of the sash from the jamb, and permits reciprocation of the sash along the track guides.

Bolt 70 locks the sash at any one of a plurality of predetermined locations along the track, preventing the sash from sliding and limiting rotation. At each predetermined location an opening 74 is made in the jamb for receiving the bolt, which is slid into engagement with the opening by means of finger grip tab 78. Although opening 74 is shown as a slot, it should be understood that it can be a notch or other shape.

By means of bolt 70 and openings 74, the sash can be slid to, and locked in any one of several open positions, or fully closed, and is double locked against rotation.

Although engagement of bolts 40 and 70 is described and shown with respect to guide 26 and openings in guide 24, it should be understood that any longitudinal element or portion of a jamb may be used similarly as a receiver for bolt 40 or 70 for the above explained locking engagement.

Figure 2:
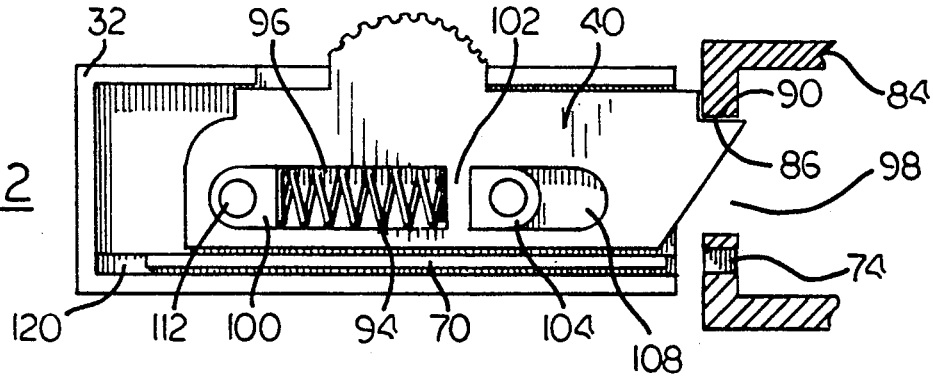
FIG. 2 is a bottom view of a latch of the present invention in one locking position.

Referring to assembly FIGS. 2 and 10, and component FIGS. 5, 6, 7, and 8; FIG. 2 shows bolt 40 in bottom view, extended from housing 32 for engagement with track 84 to resist rotation, and with bolt 70 drawn back for disengagement from the track.

Forward facing surface 86 of head 88 of bolt 40 is in locking engagement with rearward facing surface 90 of the track.

Spring 94 in elongated opening 96 of bolt 40, presses against guide post 100 in that opening, and presses against section wall 102, thereby biasing section wall 102 toward guide post 104 in elongated opening 108, and biasing the bolt toward open end 98 of housing 32.

Preferably the spring is under some compression at all times. This prevents play in the reciprocating action of the bolt and helps keep the spring in place before the latch is installed on a sash.

Fastener holes 112 in the guide posts are provided for screws 38.

Figure 3:
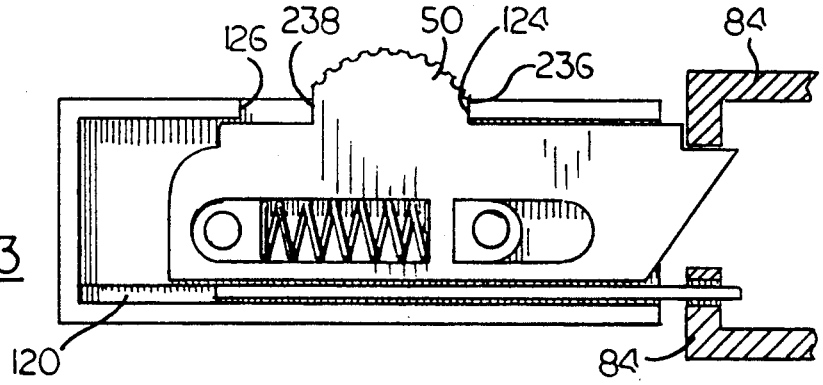
FIG. 3 is a bottom view of the latch of FIG. 2, in another locking position.

FIG. 3 shows bolts 40 and 70 extended for engagement with a track. Bolt 70 slides in guide slot 120. Right and left faces 124 and 126 of U-opening 130 (see FIG. 6) preferably limit the travel of bolt 40 by engaging right and left faces 236, 238 of finger grip button 50, in order to reduce shear loads on the guide posts.

Figure 4:
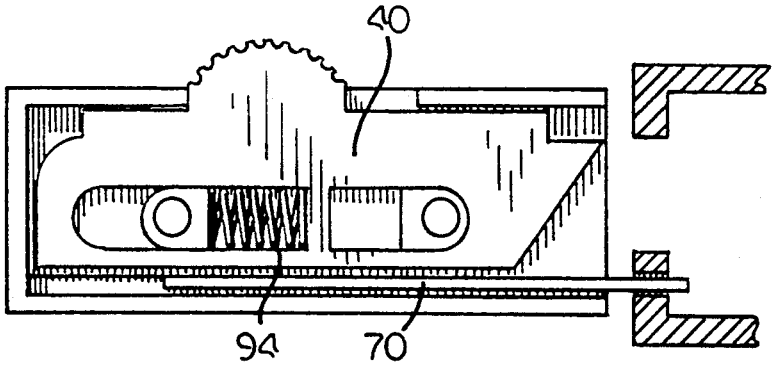
FIG. 4 is a bottom view of the latch of FIG. 2, in another locking position.

FIG. 4 shows bolt 40 drawn back, compressing spring 94, and shows bolt 70 extended.

FIG. 5 shows bolt 40 in perspective view. Openings 96 and 108 are designed for close sliding fit with guide posts 100 and 104 respectively, with the posts preferably bearing on bolt 40 to keep bolt 40 from pressing against adjacent bolt 70 by separating it from bolt 70.

Referring to FIGS. 6, 7, 8, 9, and 10, finger grip tab 78 of bolt 70 extends through slit opening 246 of guide slot 120, and receives finger grip cap 250. Preferably, bolt 70 is not spring loaded, and remains at rest due to friction with surfaces of the housing.

Preferably window latch 30 is mounted in pairs, one unit on each top corner of the lower sash of single hung tilt windows.

Latch 30 is also preferably mounted on both top corners of the upper and lower sash of double hung tilt windows. Since, however, the units on the upper sash are usually inaccessible when the sash is closed, it may be necessary to add a separate sash lock for the upper sash.

By the above description and drawings it is seen that the latch of the present invention provides a snap tilt lock, a vent lock by locking the sash at any one of a plurality of locations along the track, and a double security sash lock to prevent unauthorized opening of the sash.

While a preferred embodiment of the present invention has been described in detail, it will be understood that other embodiments and modifications thereof are contemplated by the inventor. It will be understood that changes in form and arrangement of parts and in the specific manner of practicing the invention may be made without departing from the scope of the invention. It is the intention to include within the scope of the invention all embodiments and modifications as are defined by the appended claims.

what is claimed is:

1. A tilt sash latch comprising:

a housing including a first wall, a second wall upstanding from said first wall, and a third wall upstanding from said first wall and generally parallel to said second wall, said housing having a first end and a second end, said first and second ends being on a line that is generally parallel to said second and third walls, a first post, and a second post, said first and second posts being upstanding each form said first wall, spaced each from said second and third walls, and being spaced from one another generally inthe directions of said first and second ends, said second post being toward said second end, a first bolt, said first bolt including a first elongated opening and a second elongated opening, said bolt being mounted slidingly in said housing with said first post in said first opening and said second post in said second opening, so that said bolt may slidingly reciprocate toward said first and second ends of said housing, said bolt being extendible beyond the second end of said housing, spring means, in one of said openings in said bolt, enclosed on three sides by said bolt, and on a fourth side by the post in the opening, for bearing upon said post and said bolt for urging said bolt toward said second end of said housing, a second bolt, said first wall comprising holding means for receiving said second bolt slidingly for reciprocation of said second bolt toward said first and second ends of said housing, said second bolt being extendible beyond the second end of said housing for engaging said window jamb when said housing is mounted on said sash.

2. The tilt sash lock as described in claim 1, further comprising:

said holding means comprising said third wall, said first and second posts bearing on said first bolt for separating said first bolt from said second bolt.

3. The tilt sash lock as described in claim 1, further comprising:

said holding means including a groove in said first wall for receiving a portion of said second bolt in said first wall.

4. The tilt sash lock as described in claim 2, further comprising:

said holding means including a groove in said first wall for receiving a portion of said second bolt in said first wall.

5. The tilt sash lock as described in claim 3 further comprising:

said groove including a slot opening through said first wall, a portion of said second bolt extending through said slot opening, and said second wall comprising an elongated opening through said second wall, a portion of said first bolt extending through said elongated opening through said second wall.

6. The tilt sash lock as described in claim 1, further comprising:

said first and second posts being in a line that is generally parallel to said second wall.

7. The tilt sash lock as described in claim 1, further comprising:

said spring means being in said first opening.

8. The tilt sash lock as described in claim 1, further comprising:

said second bolt being flat, generally normal to said first wall, and between said first bolt and a one of said upstanding walls, said first wall including an elongated opening therethrough, a portion of said second bolt extending through said elongated opening in said first wall.

9. The tilt sash lock as described in claim 8, further comprising:

a one of said upstanding second and third walls including an elongated opening therethrough, and a portion of said first bolt extending through the elongated opening in the upstanding wall.

* * * * *